US007157859B2

(12) United States Patent
Inoue

(10) Patent No.: US 7,157,859 B2
(45) Date of Patent: Jan. 2, 2007

(54) LIGHTING DEVICE AND LIGHTING SYSTEM

(75) Inventor: Takao Inoue, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/046,880

(22) Filed: Feb. 1, 2005

(65) Prior Publication Data

US 2005/0168162 A1 Aug. 4, 2005

(30) Foreign Application Priority Data

Feb. 2, 2004 (JP) ..... 2004-025499

(51) Int. Cl.
*H05B 37/00* (2006.01)
*H05B 39/00* (2006.01)
*H05B 41/00* (2006.01)

(52) U.S. Cl. ..... 315/185 R; 315/122; 315/123

(58) Field of Classification Search ..... 315/35, 315/36, 95, 96, 119, 121, 122, 123, 178, 179, 315/185 R, 185 S
See application file for complete search history.

(56) References Cited

U.S. PATENT DOCUMENTS 3,345,482 A * 10/1967 Shih-woo ..... 337/15
4,727,449 A * 2/1988 Fleck ..... 361/54
4,870,547 A * 9/1989 Crucefix ..... 362/123
5,453,664 A * 9/1995 Harris ..... 315/185 S
6,084,357 A * 7/2000 Janning ..... 315/122
6,323,597 B1 * 11/2001 Janning ..... 315/185 S
6,323,598 B1 * 11/2001 Guthrie et al. ..... 315/200 A
6,344,716 B1 * 2/2002 Gibboney, Jr. ..... 315/185 S
6,580,182 B1 * 6/2003 Janning ..... 307/36
6,670,776 B1 * 12/2003 Guthrie et al. ..... 315/200 A
6,737,814 B1 * 5/2004 Guthrie et al. ..... 315/200 A
6,765,313 B1 * 7/2004 Janning ..... 307/36
2002/0171371 A1 * 11/2002 Janning ..... 315/185 R
2005/0179400 A1 * 8/2005 Janning ..... 315/185 S

FOREIGN PATENT DOCUMENTS

JP 8-68986 3/1996
JP 2001-209049 8/2001
JP 2001-326703 11/2001

* cited by examiner

OTHER PUBLICATIONS

Wikipedia website, "Light-emitting diode", Mar. 16, 2006, website address: http://en.wikipedia.org/wiki/LED, p. 5.*

*Primary Examiner*—Don Wong
*Assistant Examiner*—Marie Antoinette Cabucos
(74) *Attorney, Agent, or Firm*—Armstrong, Kratz, Quintos, Hanson & Brooks, LLP

(57) ABSTRACT

First resistors (R1, R2) for setting a forward current value are connected in series to light-emitting diodes (LED 1, LED 2) respectively to constitute first serial circuits (112, 113), which are connected to an input terminal (111). Second serial circuits (115, 116) are connected in parallel to the first serial circuits (112, 113) respectively. The second serial circuits (115, 116) are constituted by a combination of a Zener diode (ZD1) and a second resistor (R3), and another combination of a Zener diode (ZD2) and a second resistor (R4). When a higher voltage than rated voltages of the light-emitting diodes (LED 1, LED 2) is applied, the Zener diodes (ZD1, ZD2) shunt current into the second serial circuit (115, 116) to allow the light-emitting diodes (LED 1, LED 2) to light up at desirable luminance levels different from each other. When a supplied power voltage decreases, current is not shunted, so that the same forward current flows through the light-emitting diodes (LED 1, LED 2), allowing the light-emitting diodes (LED 1, LED 2) to go off at the same timing.

7 Claims, 5 Drawing Sheets

LIGHTING DEVICE AND LIGHTING SYSTEM

BACKGROUND OF THE INVENTION

1. Field of the Invention

The present invention relates to a lighting device and a lighting system that allows a plurality of light sources to light up at different luminance levels from each other.

2. Description of Related Art

A plurality of button switches for operation setup have been provided on electric equipments such as a car-mounted audio device or air-conditioner. In order to recognize the button switches even in the dark, a lighting system having a plurality of light-emitting diodes (LEDs) functioning as light sources in a lighting device has been widely used. Also in a small-sized liquid crystal display device used for, especially, a mobile phone, a lighting system provided with a plurality of LEDs acting as a backlight is in widespread use.

As a circuit configuration of a lighting device that allows the plurality of LEDs to light up, the circuit configuration as shown in, for example, FIG. 1, in which light-emitting diodes LED 1 and LED 2 are connected in series to each other, is used in general. More specifically, since the luminance levels of the LED 1 and LED 2 are set depending on a value of flowing current, a resistor R11 for restricting current is connected in series to the serially-connected LEDs 1 and 2 for luminance setup. This circuit configuration allows the luminance levels of each of LEDs to vary in accordance with a change in a voltage value without using a constant-voltage circuit, simplifying the circuit configuration.

A curved surface is often used to provide comfort in, for example, automobile interior. Button switches of car-mounted electric equipments are accordingly provided along the curved surface in some cases. On the other hand, a lighting system is constituted by mounting the LEDs 1 and 2, as well as electric parts on a flat substrate. As a result, when the lighting device is used as light sources of the button switches disposed along the curved surface, distances from each of the button switches to the light sources become different from each other, with the result that illuminance levels of the button switches differ form each other. Therefore, the luminance levels of the light sources must be set at different levels in order for illuminance levels of the button switches to be equal to each other.

In order to set the luminance levels of the LEDs 1 and 2 in the lighting system shown in FIG. 1 at different levels, it can be considered that a serial circuit of the LED 1 and a resistor R12 for setting luminance level and another serial circuit of the LED 2 and a resistor R13 for setting luminance level are connected in parallel as shown in, for example, FIG. 2 to make values of current flowing in the LED 1 and LED 2 different from each other. However, in the circuit configuration shown in FIG. 2, a plurality of serial circuits in which the resistors R12 and R13 for setting the luminance levels of the LEDs 1 and 2 are serially connected to the LEDs 1 and 2, respectively are connected in parallel, which increases the size and complexity of the circuit configuration more than that shown in FIG. 1.

In order to cope with this problem, it can be considered that a circuit configuration as shown in FIG. 3 in which the LEDs 1 and 2 are serially connected is employed to individually set the luminance levels of the LEDs 1 and 2. That is, as shown in FIG. 3, the resistors R12 and R13 are connected to the serially-connected LEDs 1 and 2, respectively in parallel. Resistance values of the resistors R12 and R13 are set to shunt current appropriately. Forward currents of the LEDs 1 and 2 are then set for differentiating luminance levels thereof. However, as is the case with the circuit configuration shown in FIG. 2, decrease in a voltage value to be applied makes the timings for lights (LEDs) to go off different since a constant-voltage circuit is not used. That is, when a large resistance value is set in the resistor R12 (R13) for higher luminance, current easily flows through the LED 1 (LED 2) connected in parallel to the resistor R12 (R13), so that reduction in luminance is not very noticeable. On the other hand, when a small resistance value is set in the resistor R13 (R12) for lower luminance, a current does not easily flow through the LED 2 (LED 1) connected in parallel to the resistor R13 (R12) to increase reduction in luminance. Therefore, when a voltage change occurs, variation in illumination may be observed due to difference in the timings for the LEDs 1 and 2 to go off. Therefore, a constant-current circuit must be provided, which may complicate the device configuration.

As described above, the conventional lighting system that allows a plurality of light-emitting diodes LED 1 and LED 2 to light up has a problem that the size and complexity of the circuit configuration that allows a plurality of light-emitting diodes LED 1 and LED 2 to light up at different luminance levels and prevents the timings for the LEDs 1 and 2 to go off from being varied may be increased.

SUMMARY OF THE INVENTION

An object of the present invention is to provide a lighting device and a lighting system capable of easily setting lighting condition with a simple configuration.

According to the present invention, a lighting device that allows a plurality of serially-connected light sources to light up, includes: current setting sections that are connected in series to the light sources respectively to constitute serial circuits and set a forward current value flowing through the light sources; and shunt sections that are connected in parallel to at least one of the serial circuits constituted by the current setting sections and light sources and shunt current when a voltage higher than rated voltages of the light sources is applied to the serial circuits.

According to the present invention, a lighting system includes the above-described lighting device and a plurality of light sources that light up by being supplied with a power from the lighting device.

BRIEF DESCRIPTION OF THE DRAWINGS

FIG. 2 is a circuit diagram showing a lighting circuit that the present invention is based on;

FIG. 3 is a circuit diagram showing another lighting circuit that the present invention is based on;

DETAILED DESCRIPTION OF PREFERRED EMBODIMENTS

Figure 4:
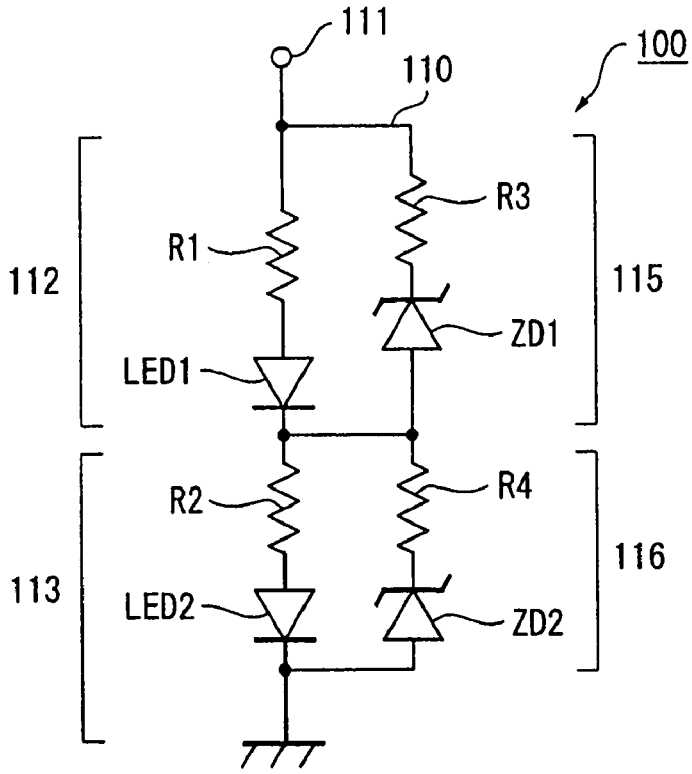
FIG. 4 is a circuit diagram schematically showing a configuration of a lighting system according to the present invention.

Embodiments of the present invention will be described below with reference to the accompanying drawings. In the following embodiments, a light-emitting diode (LED) is used as a light source. The light source used in the present invention is not limited to the LED, and any light emitting object including, for example, a lamp such as an electric bulb can be applied. FIG. 4 is a circuit diagram schematically showing a configuration of a lighting system according to the present invention.

(Configuration of Lighting System)

In FIG. 4, a reference numeral 100 denotes a lighting system. The lighting system 100 is used as an illumination necessary for button switches or knobs for setting operations of a car-mounted audio device or air-conditioner, or used as a backlight of a display device such as a liquid crystal panel that displays operation items or setting items. The lighting system 100 includes a plurality of (for example, two) light-emitting diodes LED 1 and LED 2 serving as light sources, and a lighting device 110 that allows the LEDs 1 and 2 to light up. Note that the number of light-emitting diodes is not limited to two. The lighting device 110 includes an input terminal 111. The lighting device 110 responds to a switch operation for turning ON, for example, headlights of a car. A power is supplied to the input terminal 111 based on the switch operation for turning ON the headlights. The power supplied to the input terminal 111 also includes a power that is supplied from a power source in which a constant-current circuit is not provided, and therefore a current value fluctuates.

Connected in series to the input terminal 111 are a plurality of first serial circuits 112 (113) each constituted by a first resistor R1 (R2) serving as a current setting section and the LED 1 (LED 2) serving as a light source. Here, two first serial circuits 112 and 113 are serially connected to each other between the input terminal 111 and a ground. Setting of the first resistors R1 and R2 of the first serial circuits 112 and 113 at predetermined resistance values sets current values of a forward current that flows through the first serial circuits 112 and 113, and at the same time, absorbs variation in rated voltage of the LEDs 1 and 2.

Further, in the lighting device 110, a second serial circuit 115 (116) serving as a shunt section constituted by a second resistor R3 (R4) and a Zener diode ZD1 (ZD2) is connected in parallel to the first serial circuit 112 (113). That is, a node A between the LED 1 of the first serial circuit 112 and the first resistor R2 of the first serial circuit 113 is connected to a node B between the Zener diode ZD 1 of the second serial circuit 115 and the second resistor R4 of the second serial circuit 116. The second serial circuit 115 (116) shunts current such that a value of forward current flowing through the first serial circuit 112 (113) does not exceed a predetermined current value. That is, the second serial circuit 115 (116) sets the luminance level of LED 1 (LED 2).

Each of the Zener diodes ZD 1 and ZD2 of the second serial circuits 115 and 116 has a Zener voltage, which is breakdown voltage, equivalent to or slightly higher than each of rated voltage values of the corresponding light-emitting diodes LED 1 and LED 2. Therefore, when the voltage value to be applied to the input terminal falls below the rated voltage, current does not flow through the second serial circuits 115 and 116, but flows only through the first serial circuits 112 and 113, with the result that the same current flows through the LEDs 1 and 2. As a result, the timings for the LEDs 1 and 2 to go off become the same.

(Operation of Lighting System)

Next, operation of the lighting system 100 will be described.

When a power is supplied to the input terminal 111, a predetermined voltage is applied to each of the first serial circuit 112 and second serial circuit 115. When the voltage in the supplied power is higher than the Zener voltage of the Zener diode ZD1, current is shunted through the second serial circuit 115 and the first serial circuit 112. The current amounts in this case depend on the magnitude of each of the first and second resistors R1 and R3. The LED 1 emits light at a luminance level corresponding to the magnitude of the current flowing through the first serial circuit 112. Likewise, when a predetermined voltage is applied to each of the first serial circuit 113 and second serial circuit 116, and the predetermined voltage is higher than the Zener voltage of the Zener diode ZD2, current is shunted through the second serial circuit 116 and the first serial circuit 113, with the result that the LED 2 emits light at a luminance level corresponding to the magnitude of the current flowing through the first serial circuit 113.

On the other hand, when the voltage to be applied to the input terminal 111 falls below each of the Zener voltages, due to the case where a power is supplied from a battery of a car to other electrical equipment or due to a decrease in battery charge amount, current does not flow through the second serial circuits 115 and 116 but flows through the first serial circuits 112 and 113. In the case where the voltage does not fall below the Zener voltage of the Zener diode ZD2 (ZD1), current flows through the second serial circuit 116 (115) unless the voltage falls below the Zener voltage of ZD2 (ZD1). In this case, current flows through the first serial circuit 113 (112) connected in parallel to the second serial circuit 116 (115) to allow the LED 2 to emit light at a corresponding luminance level. The power voltage decreases and current is not shunted through the second serial circuits 115 and 116, so that each of the light emitting-diodes LED 1 and LED 2 emits light at a luminance level corresponding to each of the magnitude of the current flowing through the first serial circuits 112 and 113. When current value further decreases, current is not shunted and flows only through the first serial circuits 112 and 113, with the result that the same current flows through the LEDs 1 and 2. As a result, the timings for LEDs 1 and 2 to go off become the same.

Figure 5:
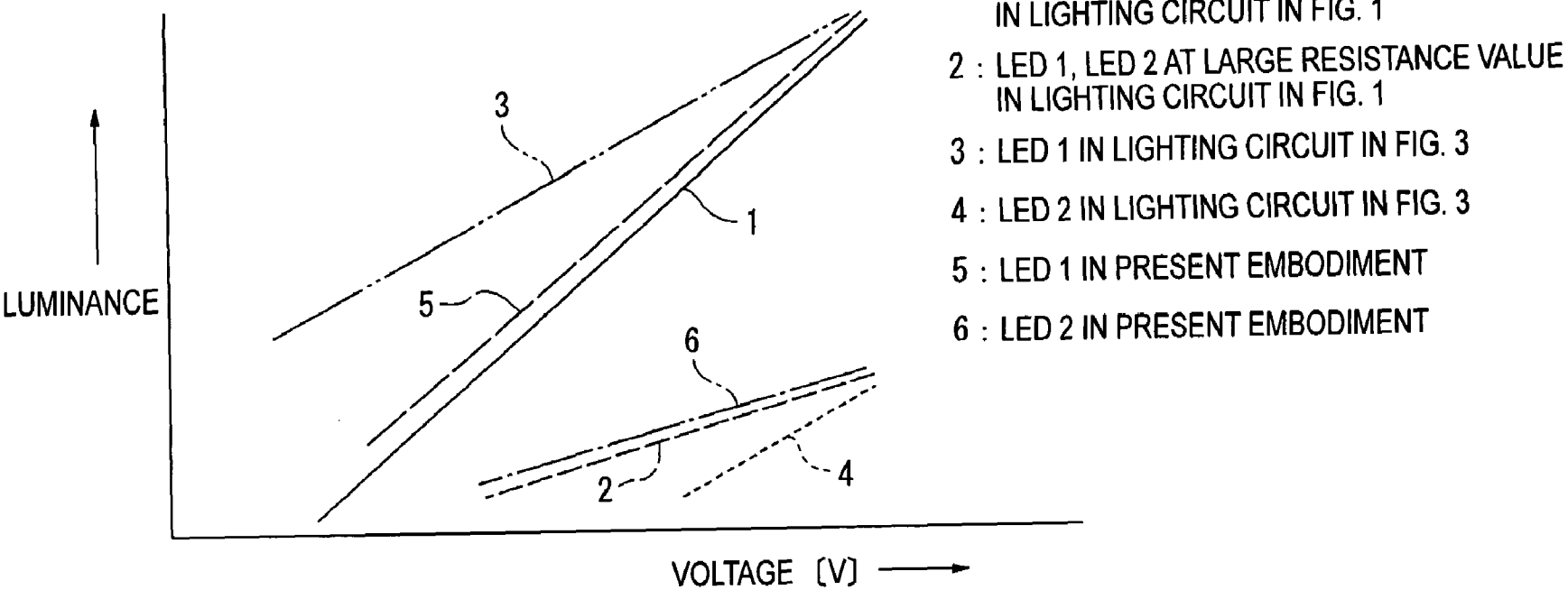
FIG. 5 is a graph for explaining lighting conditions of light-emitting diodes in an embodiment of the present invention.

Here, emission conditions of LEDs 1 and 2 will be described in contrast to comparative examples. FIG. 5 is a graph explaining lighting conditions of light-emitting diodes in the lighting system. The conventional lighting device having the circuit configuration shown in FIG. 1 and the lighting system that has the circuit configuration shown in FIG. 3 and that the present invention is based on are used as the comparative examples.

Figure 1:
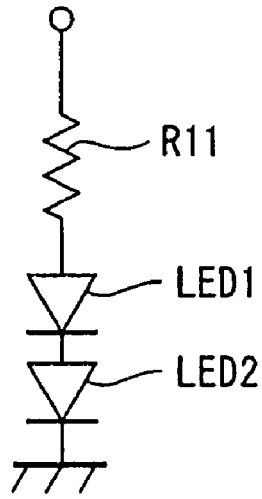
FIG. 1 PRIOR ART
FIG. 1 is a circuit diagram showing a lighting circuit of a prior art.
Figure 2:
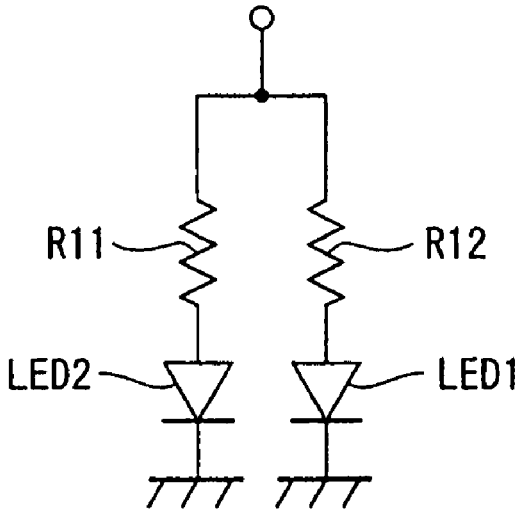
FIG. 2 PRIOR ART

The lighting circuit shown in FIG. 1 of a comparative example has the circuit configuration in which the light-emitting diodes LED 1 and LED 2 are serially connected to the resistor R11 for setting luminance. The lighting circuit shown in FIG. 3 of a comparative example has the circuit configuration in which the resistors R12 and R13 that set the luminance levels of the LEDs 1 and 2 are respectively connected in parallel to the LEDs 1 and 2 of the lighting circuit shown in FIG. 1. A large resistance value is set in the resistor R12 so as to allow the LED 1 to light up relatively brightly. On the other hand, a small resistance value is set in the resistor R13 so as to allow the LED 2 to light up relatively darkly. That is, the resistance values are set such that R12>R13. In the lighting device 110 of the present embodiment shown in FIG. 4, in order to allow the LED 1 to light up relatively brightly, a relatively small resistance value is set in the first resistor R1 and a relatively large resistance value is set in the second resistor R3. Further, in order to allow the LED 2 to light up relatively darkly, a relatively large resistance value is set in the first resistor R2 and a relatively small resistance value is set in the second resistor R4.

In the lighting circuit shown in FIG. 1 of a comparative example, all the power supplied to the input terminal 111 flows through the LEDs 1 and 2. Accordingly, the LEDs 1 and 2 light up at the same luminance levels. That is, when a relatively small resistance value is set in the resistor R11 so as to allow a luminance level of the LED 1 to become relatively high under the rated voltage, the LED 2 lights up at the same luminance level as that of the LED 1, as shown in FIG. 5 (solid line 1 in FIG. 5). On the other hand, a relatively large resistance value is set in the resistor R11 so as to allow a luminance level of the LED 2 to become relatively low under the rated voltage, the LED 1 also lights up darkly, that is, lights up at the same luminance level as that of the LED 2, as shown in FIG. 5 (dotted line 2 in FIG. 5). When the power voltage decreases and a current value flowing through the circuit correspondingly decreases, both luminance levels of the LEDs 1 and 2 are lowered equally as shown in FIG. 5 (solid line 1 and dotted line 2 in FIG. 5), with the result that the LEDs 1 and 2 go off at the same timing.

Figure 3:
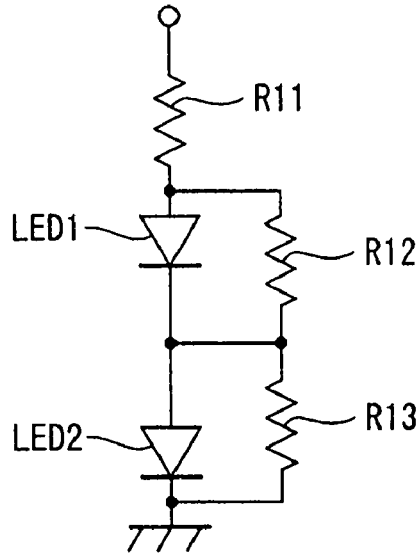
FIG. 3 PRIOR ART

In the case of the lighting circuit shown in FIG. 3 of a comparative example, the resistance values of the resistors R12 and R13 are set such that luminance levels under the rated voltage become desired luminance levels, so that each of the LEDs 1 and 2 lights up at a predetermined luminance level, as shown in FIG. 5 (two-dot chain line 3 and dotted line 4 in FIG. 5). When the power voltage to be supplied decreases and a value of the current correspondingly decreases, the degree with which the LED 2 having a low luminance level becomes dark becomes larger than the degree with which the LED 1 having a high luminance level becomes dark as shown in FIG. 5. That is, since a large resistance value has been set in the resistor R12 in order to allow the LED 1 to light up at a high luminance level, current does not easily flow through the resistor R12. Therefore, the rate at which current flows through the LED 1 becomes high, resulting in a small degree with which the LED 1 becomes dark. On the other hand, since a small resistance value has been set in the resistor R13 in order to allow the LED 2 to light up at a low luminance level, current easily flows through the resistor R13. Therefore, the rate at which current flows through the LED 2 becomes low, resulting in a large degree with which the LED 2 becomes dark. It follows that when the supplied voltage decreases, the LED 2 goes off but the LED 1 continues to light up, with the result that the timings for the LEDs 1 and 2 to go off become different. For this reason, when the lighting circuit as shown in FIG. 3 of a comparative example is used as an illumination for button switches, a backlight and so on, it is impossible to illuminate target objects evenly, which may degrade visibility.

In the case of the lighting device 110 shown in FIG. 4 of the present embodiment, the resistors R3 and R4 are set such that luminance levels under the rated voltage become desired luminance levels, so that, as is the case with the lighting circuit shown in FIG. 3 of a comparative example, each of the LEDs 1 and 2 lights up at a predetermined luminance level as shown in FIG. 5 (dotted line 5 and chain line 6 in FIG. 5). When the power voltage to be supplied decreases and a value of the current correspondingly decreases, current does not flow through the second serial circuits 115 and 116 but flows through the first serial circuits 112 and 113 as described above. Accordingly, the same forward current value is obtained through the LEDs 1 and 2, with the result that, as in the case of the lighting circuit shown in FIG. 1 of the comparative example, both luminance levels of the LEDs 1 and 2 are lowered equally as shown in FIG. 5 and the LEDs 1 and 2 go off at the same timing.

In the above embodiment, as described above, the first resistors R1 and R2 for setting values of a forward current flowing through the serially-connected LEDs 1 and 2 are connected in series to the LEDs 1 and 2, respectively, to constitute the first serial circuits 112 and 113. Further, the second serial circuits 115 and 116 are connected in parallel to the first serial circuits 112 and 113, respectively, to shunt current through the first serial circuits 112 and 113 when a higher voltage than the rated voltage of each of LEDs 1 and 2 is applied. Thus, even when a higher voltage than the rated voltage is supplied, current is shunted through the second serial circuits 115 and 116, so that each of the LEDs 1 and 2 lights up at a predetermined luminance level. When the power voltage to be supplied decreases, current does not flow through the second serial circuits 115 and 116, but flows through the first serial circuits 112 and 113. Accordingly, the same forward current value is obtained through the LEDs 1 and 2, with the result that both luminance levels of the LEDs 1 and 2 are lowered equally and the LEDs 1 and 2 go off at the same timing.

As a result, it is possible to allow the LEDs 1 and 2 to light up at desired luminance levels different from each other. It is also possible to allow the LEDs 1 and 2 to go off at the same timing without providing a constant-current circuit in a power source that supplies power to the input terminal 111. Therefore, even when a distance between a target object to be illuminated by the LED 1 and the LED 2 under the circumstances that, for example, the LEDs 1 and 2 are used as illumination for button switches or knobs disposed on a carved surface in a car-mounted audio device or air-conditioner or as a backlight, since the LEDs 1 and 2 light up at different luminance levels from each other, the same illuminance can be observed in the target objects, thereby obtaining good illumination condition in which the target objects are evenly illuminated. Further, even if the power voltage to be supplied decreases, it is possible to prevent degradation of visibility due to partial illumination for the target objects (for example, only a part of the button switches is illuminated) since the LEDs 1 and 2 go off at the same timing. Thus, even with a simple configuration in which a constant-current circuit is not used, favorable lighting condition of the LEDs 1 and 2 can be easily set and favorable light-emission properties can be obtained. Further, it is possible to easily set the luminance levels of the LEDs 1 and 2 by setting an amount of the current to be shunted through the second serial circuits 115 and 116, so that applicability can be easily enhanced, resulting in increase in versatility.

The above lighting device of the present embodiment uses the light-emitting diodes LED 1 and LED 2 as light sources. Therefore, the present embodiment can be easily configured as a small-sized lighting system 100 mounted on the same substrate as the lighting device 110. The small-sized lighting system 100 is suitable for use in relatively small-sized electric equipment such as an illumination for button switches, a backlight of a liquid crystal panel and so on. With this configuration, it is possible to easily reduce manufacturing cost.

Further, the Zener diodes ZD1 and ZD2 are provided respectively in the second serial circuits 115 and 116 to which current is shunted. The Zener diode has Zener voltage characteristics that allow Zener voltages of the ZD1 and ZD2 to be equivalent to or slightly higher than each of the rated voltage values of the corresponding light-emitting diodes LED 1 and LED 2, which makes it possible to easily obtain lighting condition in which each of the LEDs 1 and 2 lights up at a voltage substantially the same as the rated voltage. Further, the Zener diode ZD1 and ZD2 are used in order to obtain a predetermine Zener voltage. Therefore, with a simple structure, it is possible to obtain the configuration in which each of the LEDs 1 and 2 lights up at a voltage substantially the same as the rated voltage.

The second serial circuits 115 and 116 are connected in parallel to the first serial circuits 112 and 113, respectively. This configuration allows each of the LEDs 1 and 2 of the first serial circuits 112 and 113 to light up at a predetermined luminance level and allows the LEDs 1 and 2 to go off at the same timing.

As the second serial circuits 115 and 116, the second resistors R3 and R4 are connected in series to the Zener diodes ZD1 and ZD2, respectively. Therefore, even when the lighting device is used in a configuration in which a supplied voltage varies, the Zener diodes ZD1 and ZD2 can be protected. This eliminates the configuration that resists a high voltage and the structure can thus be simplified, so that it is possible to provide a circuit moderate in price. Further, it is possible to easily set an amount of the current to be shunted into the second serial circuits 115 and 116 by the second resistors R3 and R4, facilitating circuit design.

[Modification]

The present invention is not limited to the above-described embodiment, and may be modified, as described below, within a range to achieve the object of the present invention.

That is, the present invention is used as any illumination for equipments other than that for a car-mounted type, as well as an illumination for button switches or knobs for a user to set operations of a car-mounted audio device or air-conditioner and a backlight of a display device and so on as described above. Further, as a light source, any lump such as an electric bulb can be used in addition to the light-emitting diodes LED 1 and LED 2. Thus, when the light source to be used is selected depending on a target object to be illuminated, the lighting system 100 can be used as an illumination for any purpose as well as an illumination for button switches or knobs and a backlight. Further, when the lighting system 100 is configured such that a light source is detachably provided, the lighting device 110 can be used for other purposes by changing the light source.

The power to be used is not limited to that from a power source that does not include a constant-current circuit, and the power from a power source including a constant-current circuit can be used for the present invention.

The first resistors R1 and R2 are used as a current setting section for setting a value of forward current flowing through the LEDs 1 and 2 in the above embodiment. Alternatively, however, any configuration can be used as long as it can appropriately set a value of current flowing through the light sources. Further, a variable resistor that is capable of changing a resistance value may be used. By using the variable resistor, it becomes easy to set a forward current value in correspondence with serially-connected light sources, easily increasing productivity and versatility.

Figure 6:
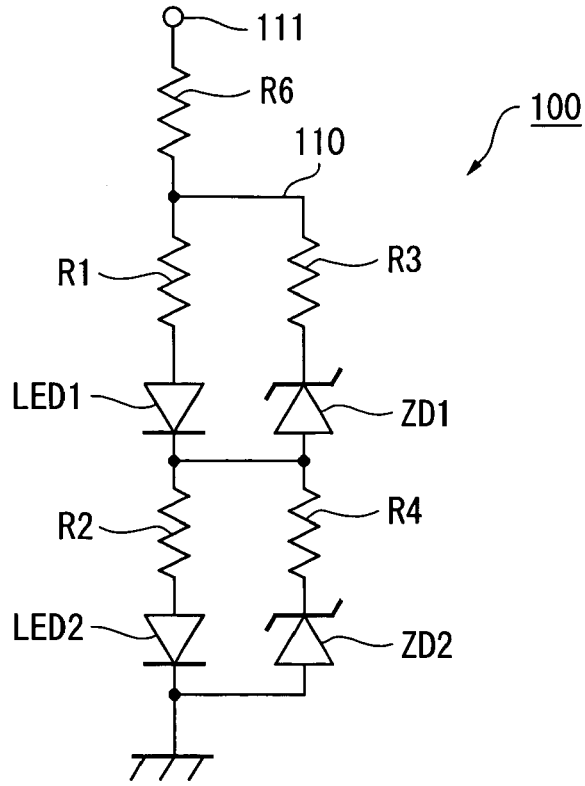
FIG. 6 is a circuit diagram showing a lighting system according to another embodiment of the present invention.

As a configuration that sets the entire luminance of the LEDs 1 and 2, a third resistor R6 serving as a main current setting section may be connected in series to the LEDs 1 and 2, as shown in FIG. 6. According to the configuration as shown in FIG. 6, it is possible to set the entire luminance with a simple structure in which the only single third resistor R6 is provided, and to protect the Zener diodes ZD1 and ZD2, thereby easily increasing productivity and reducing manufacturing cost due to the simplified structure. The main current setting section for setting the entire current value is not limited to the resistor R6 and any configuration may be used. Further, the resistor R6 may be variable resistor. With the configuration, it is possible to adjust the entire luminance, further improving productivity and manufacturing cost.

The shunt section for shunting current in order to set luminance levels of the LEDs 1 and 2 is not limited to the second serial circuits 115 and 116 having the Zener diodes ZD1 and ZD2. Alternatively, however, a switching device such as a thyristor or transistor may be used to appropriately shunt current to set values of a current flowing through the LED 1 and 2 for obtaining predetermined luminance levels. Further, any configuration may be used as long as it has breakdown voltage characteristics equivalent to or higher than the rated voltages of the LEDs 1 and 2 of the first serial circuits 112 and 113. The breakdown voltage characteristic is not limited to the Zener voltage.

Figure 7:
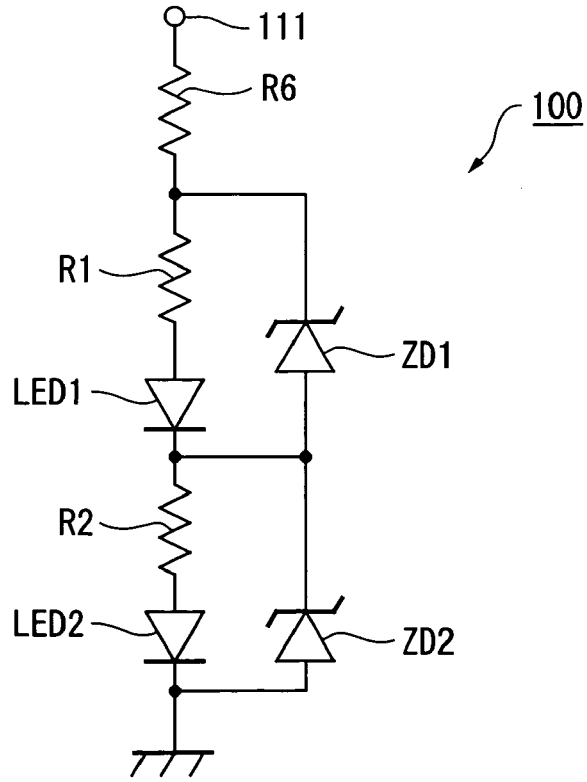
FIG. 7 is a circuit diagram showing a lighting system according to still another embodiment of the present invention.

Although the second resistors R3 and R4 are provided as the shunt section, the configuration without the second resistors R3 and R4 as shown in, for example, FIG. 7 may be used. In this case, it is preferable to use the configuration as shown in FIG. 6 in which the resistor R6 for setting the entire current value is provided. With the configuration, the resistor R6 protects the Zener diodes ZD1 and ZD2, thereby simplifying the structure and reducing manufacturing cost. Further, the second resistors R3 and R4 may be variable resistors. This configuration allows the luminance of the LEDs 1 and 2 to be adjusted, further increasing versatility.

Figure 8:
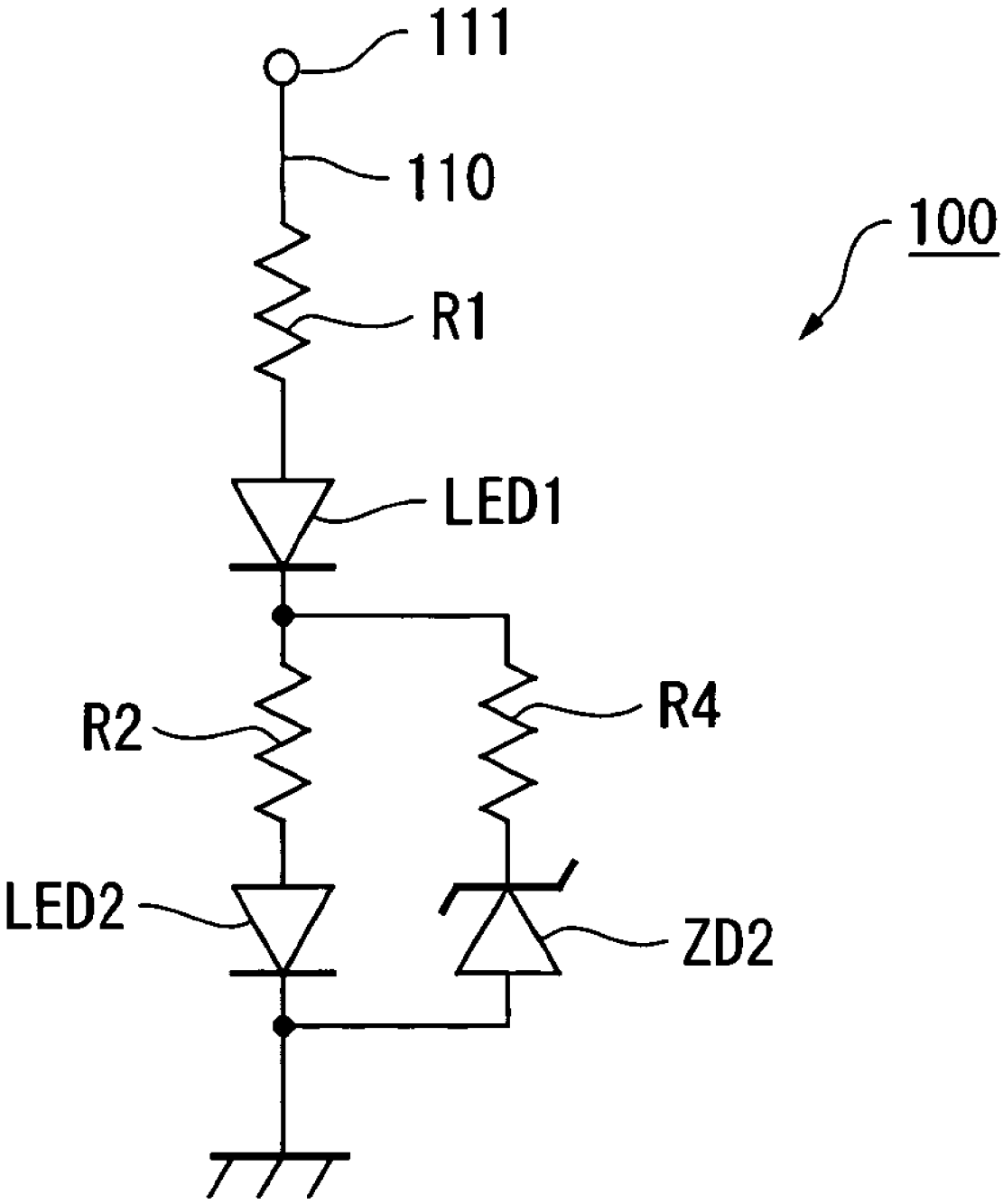
FIG. 8 is a circuit diagram showing a lighting system according to yet another embodiment of the present invention.

The second serial circuits 115 and 116 are connected in parallel to the first serial circuits 112 and 113, respectively. Alternatively, however, in order to differentiate the luminance levels of the LEDs 1 and 2, it is only necessary that at least one serial circuit 113 (112) is connected in parallel to the second serial circuit 116 (115) that allows current to be shunted into the serial circuit 113, as shown in FIG. 8. In the circuit configuration shown in FIG. 8, the luminance of the LED 1 varies in accordance with a change in the magnitude of a current value of a supplied power. On the other hand, the luminance of the LED 2 is set based on the residual current value obtained when current is shunted into the second serial circuit 116. When the supplied current value decreases and current does not flow through the second serial circuit 116, the LEDs 1 and 2 go off at the same timing as described above, thereby obtaining the same advantage as the above embodiment.

Concrete structures and procedures of the present invention may be modified into other structure or the like within a range to achieve the object of the present invention.

[Advantage of Embodiments]

As described above, the first resistors R1 and R2 for setting values of a forward current flowing through the serially-connected light-emitting diodes LED 1 and LED 2 are connected in series to the LEDs 1 and 2, respectively, and one of the second serial circuits 115 and 116 that allow current to be shunted when a higher voltage than the rated voltages of the LEDs 1 and 2 is applied is connected in parallel to at least one of serial circuits constituted by a combination of the LED 1 and the first resistor R1 and another combination of the LED 2 and the first resistor R2. As a result, it is possible to allow the LEDs 1 and 2 to light up at predetermined luminance levels by the second serial circuits 115 and 116 connected in parallel to the LEDs 1 and 2, respectively. Further, when the supplied voltage decreases and current is not shunted into the second serial circuits 115 and 116, the same forward current flows through the LEDs 1 and 2, allowing the LEDs 1 and 2 to go off at the same timing. Thus, it is possible to easily set good lighting condition of the LEDs 1 and 2 even with a simple structure in which, for example, a constant-current circuit is not used.

The priority application Number JP 2004-025499 upon which this patent application is based is hereby incorporated by reference.

What is claimed is:

1. A lighting device that allows a plurality of light emitting diodes to light up, the plurality of light emitting diodes including a first light emitting diode and a second light emitting diode that are connected in series, the lighting device comprising:

current setting sections that are connected in series to the first light emitting diode and the second light emitting diode respectively to constitute a first serial circuit and a second serial circuit, the current setting sections setting a forward current value flowing through the first light emitting diode and the second light emitting diode; and a first shunt section and a second shunt section that are respectively connected in parallel to the first serial circuit and the second serial circuit, the shunt sections each shunting a current when a voltage higher than a rated voltages of each of the light emitting diodes of the serial circuits is applied to each of the serial circuits, wherein the first and second shunt sections include a first Zener diode and a second Zener diode respectively, the first and second Zener diodes being connected in parallel to the first and second serial circuits respectively, and Zener voltages of the first and second Zener diodes are different from each other.

2. The lighting device according to claim 1, wherein the first and second Zener diodes have characteristics of breakdown voltage that assume voltages equivalent to or higher than the rated voltages of the light sources in the serial circuits connected in parallel thereto.

3. The lighting device according to claim 1, comprising:

a main current setting section that is connected in series to the first and second serial circuits and sets a current value flowing through the first and second serial circuits.

4. The lighting device according to claim 3, wherein the main current setting section is a resistor.

5. The lighting device according to claim 1, wherein each of the shunt sections includes a resistor connected in series to each of the first and second Zener diodes.

6. The lighting device according to claim 1, wherein the current setting sections are resistors, and resistance values of the resistors of the first and second serial circuits are different from each other.

7. A lighting system comprising:

a lighting device according to claim 1; and a plurality of light emitting diodes that light up by being supplied with a power from the lighting device.

* * * * *